US009352934B1

(12) United States Patent
Lee

(10) Patent No.: US 9,352,934 B1
(45) Date of Patent: May 31, 2016

(54) ELEVATOR POSITIONING SYSTEM AND METHOD

(71) Applicant: ThyssenKrupp Elevator Corporation, Atlanta, GA (US)

(72) Inventor: Sang W. Lee, Germantown, TN (US)

(73) Assignee: THYSSENKRUPP ELEVATOR CORPORATION, Atlanta, GA (US)

( * ) Notice: Subject to any disclaimer, the term of this patent is extended or adjusted under 35 U.S.C. 154(b) by 551 days.

(21) Appl. No.: 13/802,368

(22) Filed: Mar. 13, 2013

(51) Int. Cl.
*B66B 1/34* (2006.01)

(52) U.S. Cl.
CPC ..... *B66B 1/3492* (2013.01)

(58) Field of Classification Search
CPC ..... B66B 1/3492
USPC ..... 187/247, 391, 394, 414
See application file for complete search history.

(56) References Cited

U.S. PATENT DOCUMENTS 4,433,756 A 2/1984 Caputo et al.
4,750,592 A 6/1988 Watt
4,798,267 A * 1/1989 Foster ..... B66B 1/3492 187/389
5,135,081 A 8/1992 Watt
1,920,590 A 8/1993 Pedersen
5,677,519 A * 10/1997 Herkel ..... B66B 1/3492 187/283
5,798,490 A 8/1998 Vairio et al.
5,889,239 A 3/1999 Blackaby et al.
5,893,433 A 4/1999 Koura
5,925,859 A * 7/1999 Miller ..... B66B 1/50 187/283
6,128,116 A * 10/2000 Dobler ..... B66B 1/50 187/391
6,276,493 B1 8/2001 Estallo
6,283,253 B1 9/2001 Folli et al.
6,435,315 B1 * 8/2002 Zaharia ..... B66B 1/3492 187/394
6,612,403 B2 9/2003 Silberhorn et al.
6,622,827 B1 9/2003 Disieno
6,886,667 B2 * 5/2005 Kunz ..... B66B 7/022 187/394

(Continued)

FOREIGN PATENT DOCUMENTS

DE 10 2009 054 337 6/2011
JP H 02048389 A 2/1990

OTHER PUBLICATIONS

International Search Report and Written Opinion dated Jan. 20, 2015 for Application No. PCT/US2014/056507.

*Primary Examiner* — Anthony Salata
(74) *Attorney, Agent, or Firm* — Frost Brown Todd LLC

(57) ABSTRACT

An elevator positioning system includes an optical tape, optical tape clips, and a sensor. The optical tape clips are resiliently biased and mount to various structures including mounting bracket that attach to elevator guide rails or other framework within the hoistway. A connecting member of the optical tape clips is configured to be disposed between a sensor and optical tape such that the sensor detects an interruption in the optical tape and can send signals to an elevator controller in response to detecting these interruptions. The position of the optical tape clips is such that the elevator car can be controlled to align evenly with the landings associated with the hoistway.

15 Claims, 11 Drawing Sheets

(56) References Cited

U.S. PATENT DOCUMENTS

| | | | | |
|---|---|---|---|---|
| 6,945,296 | B2 * | 9/2005 | Kunz | B66B 1/3492 156/391 |
| 6,986,409 | B2 * | 1/2006 | Birbaumer | B66B 1/3492 187/394 |
| 7,562,747 | B2 | 7/2009 | Marchesi | |
| 7,571,791 | B2 * | 8/2009 | Finn | B66B 1/40 187/393 |
| 7,597,176 | B2 * | 10/2009 | Zaharia | B66B 1/3492 187/394 |
| 7,600,613 | B2 * | 10/2009 | Kang | G06K 7/10079 187/283 |
| 7,669,696 | B2 | 3/2010 | Osmanbasic | |
| 8,985,281 | B2 * | 3/2015 | De Coi | B66B 1/3492 187/394 |
| 2003/0070883 | A1 | 4/2003 | Foster et al. | |
| 2013/0284544 | A1 | 10/2013 | De Coi et al. | |
| 2015/0060213 | A1 * | 3/2015 | De Coi | B66B 1/3492 187/394 |
| 2015/0096844 | A1 * | 4/2015 | Lee | B66B 1/3492 187/394 |
| 2015/0102097 | A1 * | 4/2015 | Schatt | B66B 1/3492 235/375 |

* cited by examiner

ELEVATOR POSITIONING SYSTEM AND METHOD

BACKGROUND

In the field of elevators, it is desirable to properly position elevator cars at landings in a building to aid with the entry, exit, and safety of elevator car passengers. While there may be devices and method that attempt to accomplish this, it is believed that no one prior to the inventor(s) has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements.

Figure 1:
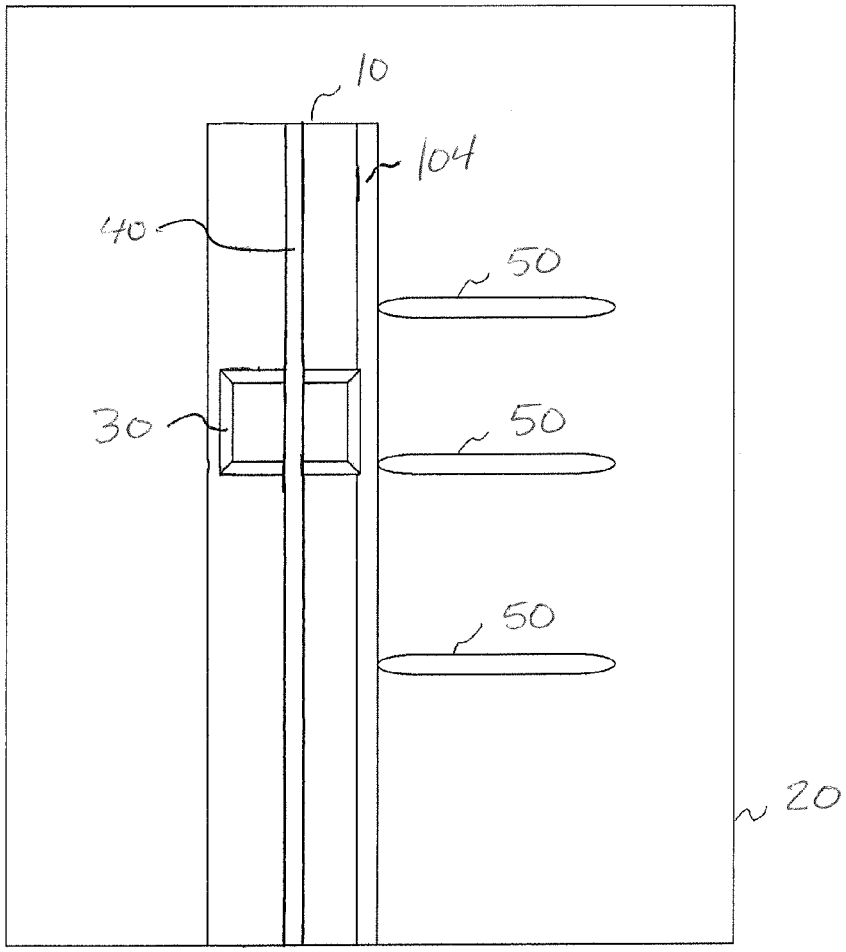
FIG. 1 depicts an elevation view of an exemplary building including a hoistway with an elevator car configured to travel along rails in the hoistway to various landings.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

FIG. 1 illustrates an exemplary hoistway (10) in and exemplary building (20). An exemplary elevator car (30) travels along exemplary guide rails (40) in hoistway (10) to transport passengers between various exemplary landings (50) in a manner as will be apparent to one of ordinary skill in the art in view of the teachings herein. As described further below with reference to FIGS. 2-15, an elevator car positioning system and method comprises an optical tape (110) and optical tape clips (112) that are used with sensors to detect interruptions in the optical tape to transmit a signal to a controller indicating that elevator car (30) is approaching one of landings (50) and to control speed and position of elevator car (30) to stop elevator car (30) at the approaching landing (50) such that elevator car (30) is aligned or substantially aligned with a floor surface of landing (50).

Exemplary Elevator Positioning Systems

Figure 2:
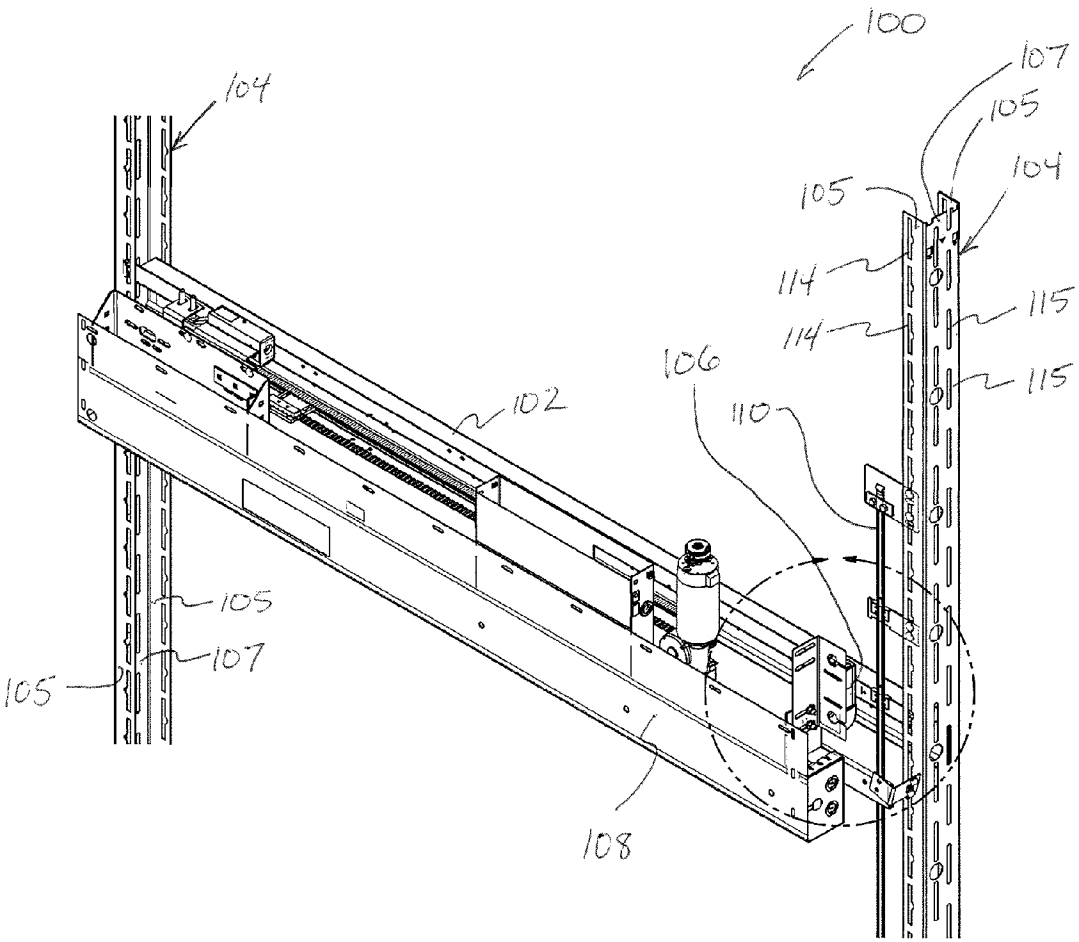
FIG. 2 depicts a partial perspective view of an exemplary hoistway showing an exemplary optical tape clip and other components installed within the hoistway.
Figure 3:
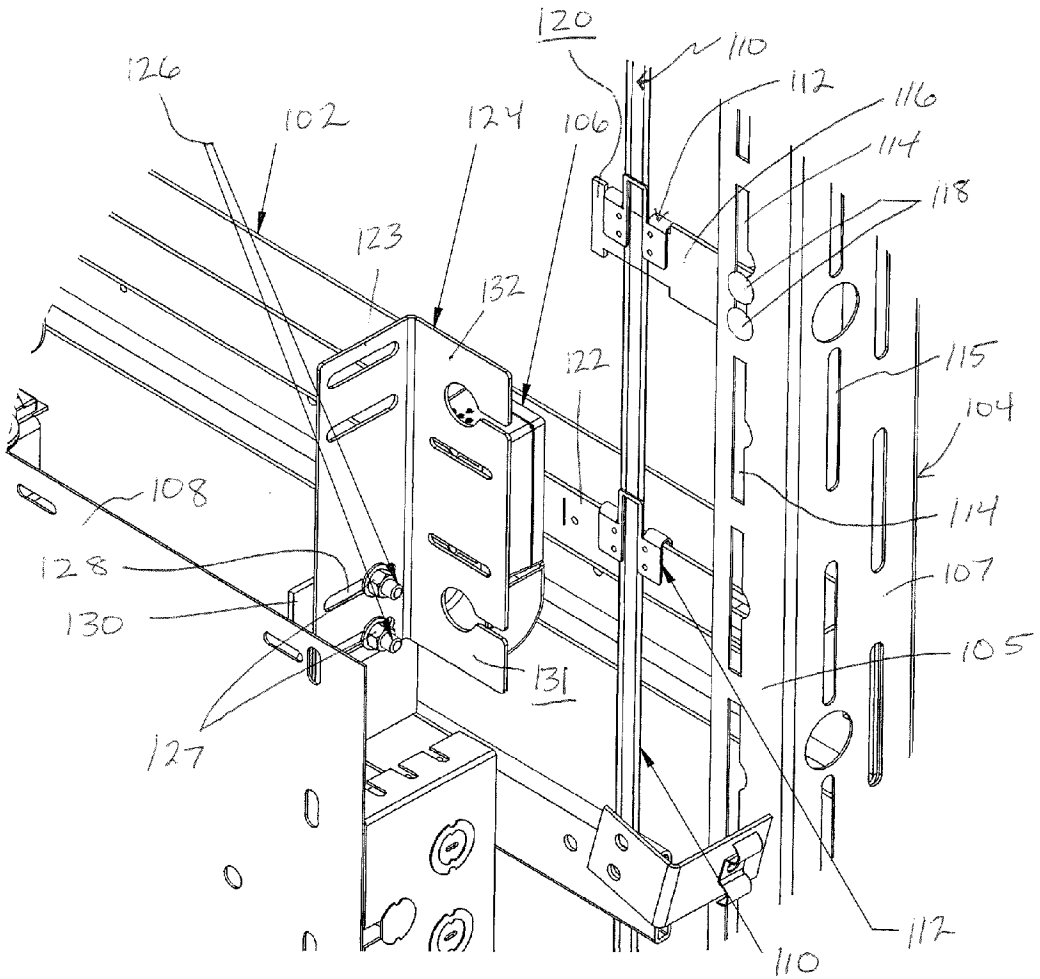
FIG. 3 depicts a detail view of a portion of the hoistway shown in FIG. 2.

FIGS. 2 and 3 illustrate an exemplary elevator positioning system (100) that comprises hoistway header (102), entrance struts (104), sensor (106), elevator door operator assembly (108), optical tape (110), and optical tape clips (112). Hoistway header (102) is a component of a hoistway frame that is connected to hoistway (10). In the present example, hoistway header (102) is disposed near the top of an entryway to one of landings (50). As will be understood by those of ordinary skill in the art in view of the teachings herein, the entryway comprises an opening that can be substantially similarly sized to the opening defined by the one or more doors of elevator car (30). Hoistway header (102) includes bent portion (122) that, in the present example but not required in all examples, extends along the length of hoistway header (102).

Struts (104) comprise first strut portion (105) including slots (114) and second strut portion (107) positioned, in the illustrated version, generally perpendicular to first strut portion (105) with second strut portion (107) including slots (115). Mounting brackets (116) are configured for selective attachment with struts (104). Mounting brackets (116) include connectors (118) that are sized and shaped to be received through an enlarged portion of slots (114) and are slidable along slots (114) to securely positioned mounting bracket (116) to strut (104). When secured to struts (104), mounting brackets (116) transversely project from struts (104) such that a first surface (120) of mounting bracket (116) faces elevator car (30). Mounting brackets (116) are optional features that provide a location for attaching an optical tape clip (112) for elevators with reverse entrances.

Elevator car (30) includes elevator door operator assembly (108) to which sensor (106) is attached in the present example. Elevator door operator assembly (108) is generally located above and directly or indirectly connected with the elevator doors so as to open and close the doors in operation. In view of the teachings herein, those of ordinary skill in the art will understand suitable configurations for and operability of elevator door operator assembly (108).

In the present example, sensor (106) is an optical sensor such as an absolute positioning sensor or other suitable sensor as will be apparent to one of ordinary skill in the art in view of the teachings herein. Sensor (106) is configured to detect the presence of optical tape (110). By way of example only, and not limitation, in some versions sensor (106) is spaced about 102 mm from optical tape (110). In such a configuration, sensor (106) measures the central area of optical tape (110). In some versions sensor (106) has a field of view of plus or minus 10 mm from a centerline of optical tape (110). In the present example, sensor (106) connects with elevator door operator assembly (108) via bracket (124). A first portion (123) of bracket (124) is configured to attach to a portion (130) of elevator door operator assembly (108) via fastener components such as bolts, screws, etc. In the present example as shown in FIG. 3, first portion (123) of bracket (124) comprises slots (128) and threaded bolts (126) extend through slots (128) and through corresponding slots (not shown) in portion (130) of elevator door operator assembly (108). Corresponding threaded nuts (127) engage with threaded bolts (126) to securely connect bracket (124) with elevator door operator assembly (108). A second portion (132) of bracket (124) transversely projects from first portion (123) such that a first surface (131) of second portion (132) faces elevator door operator assembly (108) and an opposing second surface faces landings (50). A rear portion of sensor (106) is configured to attach to the second surface of second portion (132) of bracket (124) such that a front, detecting portion of sensor (106) faces toward optical tape (110) as shown in FIG. 3.

Optical tape (110) is made from a durable and dimensionally stable material that is suitable for detection by sensor (106). In some versions optical tape (110) is constructed of a plastic film attached to a retroreflective background adhered to a metal band. Other suitable materials, construction, and configuration for optical tape (110) will be apparent to those of ordinary skill in the art in view of the teachings herein. In the present example optical tape (110) comprises a central region and outer regions on each side of the central region. Sensor (106) is generally calibrated to detect the central region of optical tape (110), which may have a different color, pattern, or material than outer regions. Optical tape (110) generally extends at least the length of the travel distance of elevator car (30).

Figure 4:
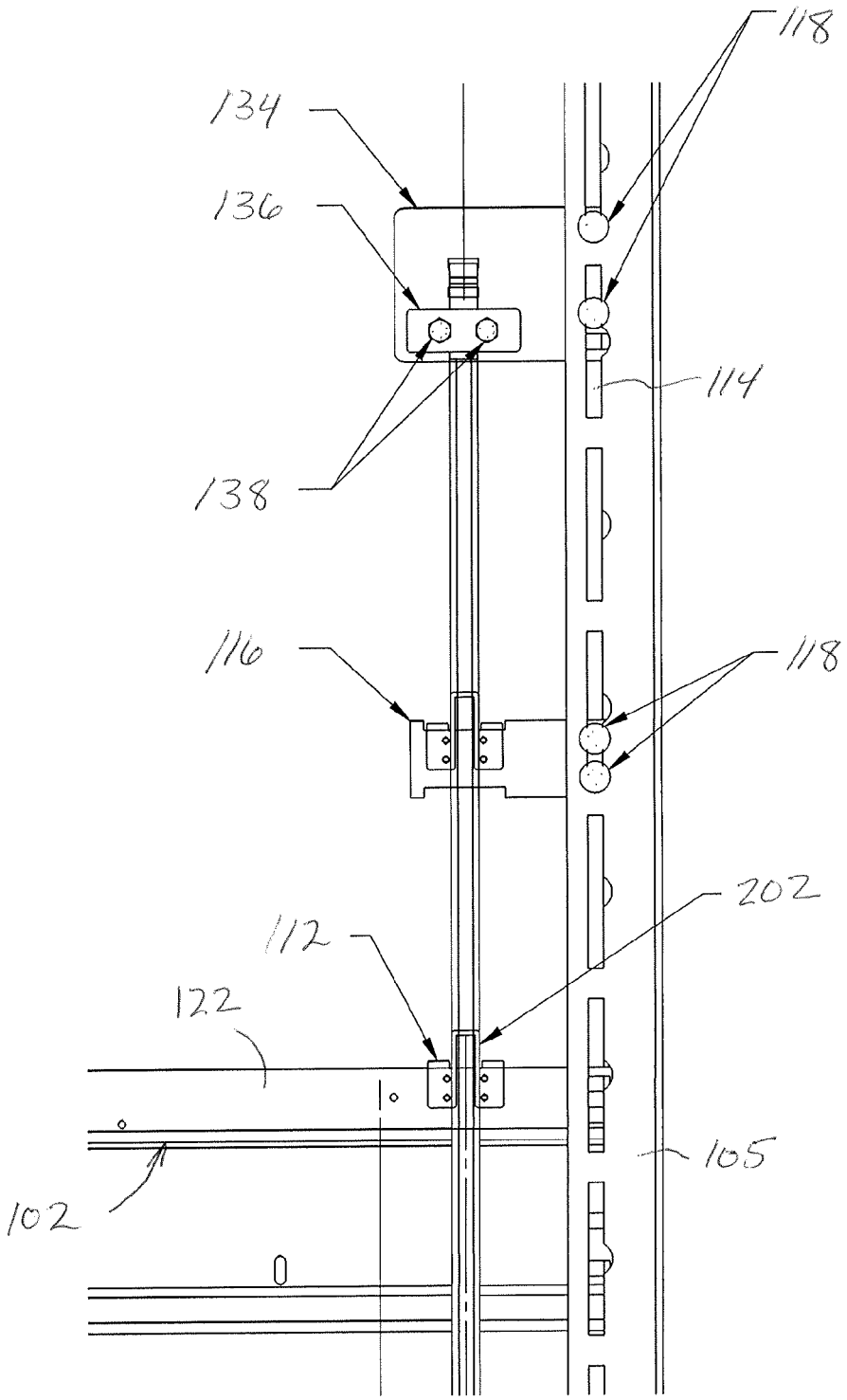
FIG. 4 depicts a side view of a top portion of the hoistway of FIG. 2.
Figure 5:
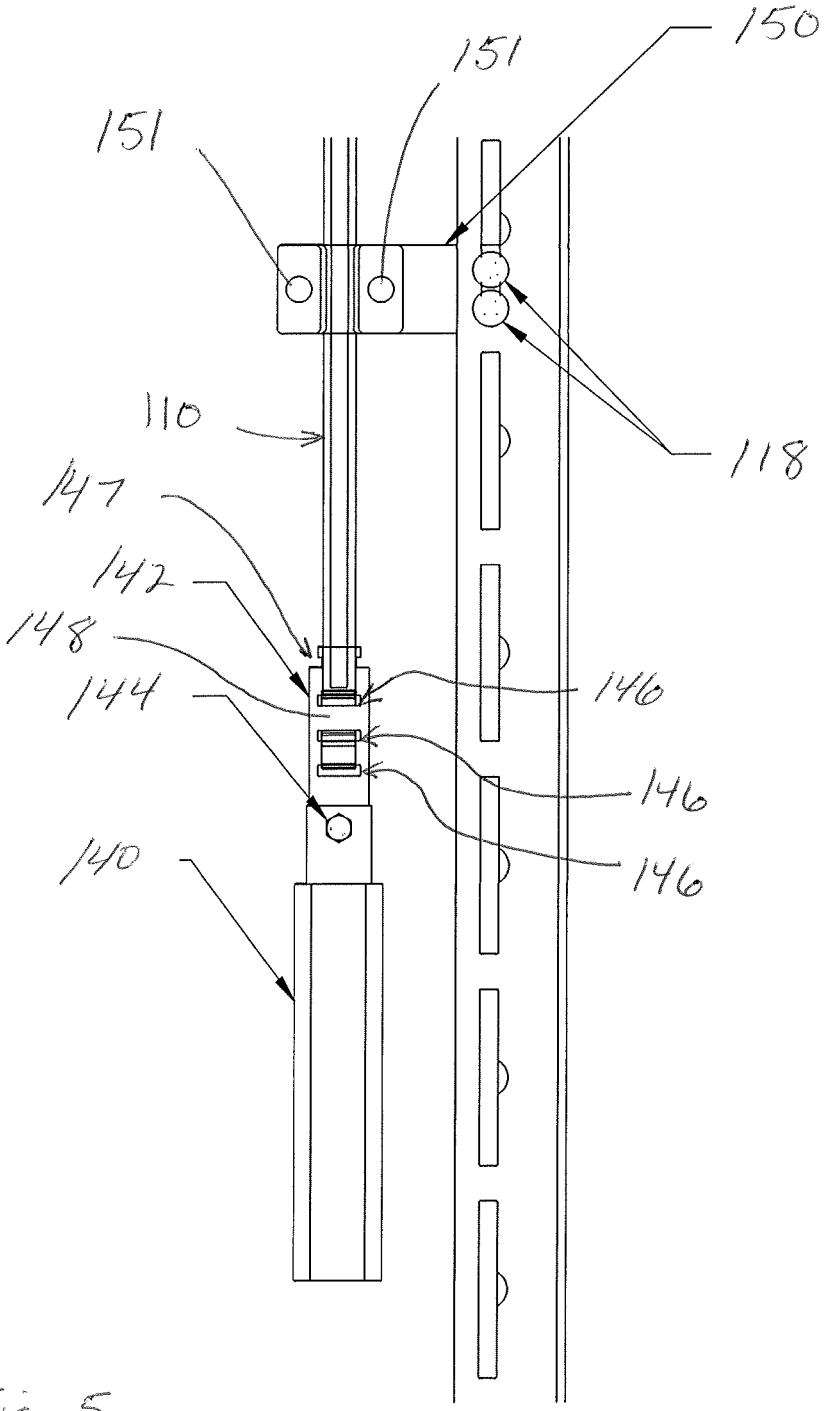
FIG. 5 depicts a side view of a bottom portion of the hoistway of FIG. 2.

FIGS. 4 and 5 illustrate how optical tape (110) is mounted near top and bottom portions of hoistway (10). FIG. 4 shows a top or upper portion of hoistway (10) including top mounting bracket (134) that includes connectors (118) sized and shaped to be securely positioned within slots (114) in the same or similar manner described above with respect to mounting bracket (116). In the present example, top mounting bracket (134) includes a pair of apertures and clamp (136) to receive and retain optical tape (110). In one example, optical tape (110) is threaded through the apertures forming a loop near the upper part of optical tape (110). In such a configuration, the free end of optical tape (110) first passes through a bottom aperture of top mounting bracket (134) from a first surface (137) of top mounting bracket (134), then passes through top aperture of top mounting bracket (134) from a second surface (not shown) of top mounting bracket (134), then extends downward to a position adjacent the remainder of optical tape (110) contacting top mounting bracket (134). Optical tape (110) is then secured with clamp (136), which compresses optical tape (110) between clamp (136) and first surface (137) of top mounting bracket (134). Clamp (136) connects with top mounting bracket (134) via a bolted connection (138) in the present example, however other ways to connect clamp (136) to top mounting bracket (134) will be apparent to those of ordinary skill in the art in view of the teaching herein.

FIG. 5 shows a bottom or lower portion of hoistway (10) including weight (140) that is fastened to a bottom mounting plate (142) though means such as fastener (144), which may be a screw or other fastener as will be apparent to one of ordinary skill in the art in view of the teachings herein. Weight (140) may weigh, for example, 4.54 kg or another suitable weight as will be apparent to one of ordinary skill in the art in view of the teachings herein. Bottom mounting plate (142) includes three apertures (146) and narrow portion (147). Bottom mounting plate (142), in one example, is configured to receive optical tape (110) in a weaving manner via apertures (146) before optical tape (110) is secured by a cable tie around optical tape (110) at narrow portion (147). In some versions, optional bracket (150) is configured to receive optical tape (110) and is configured to be disposed substantially near and above bottom mounting plate (142). Bracket (150) is fastened to strut (104) through fasteners (118) in a manner as will be apparent to one of ordinary skill in the art in view of the teachings herein. Bracket (150) comprises guides (151) that protrude at least slightly from bracket (150) and are configured to stabilize optical tape (110) above bottom mounting plate (142) and weight (140) from undesired swaying motion. In view of the teachings herein, other ways to mount optical tape (110) within hoistway (10) will be apparent to those of ordinary skill in the art.

FIGS. 6-11 illustrate exemplary optical tape clip (112). In at least some versions, optical tape clips (112) are considered a type of positioning member as they aid in positioning elevator car (30). In some versions, optical tape clip (112) weighs about 23 grams, although other weights may be used. Optical tape clip (112) includes arms (200) with a bridge member (202) disposed between and connecting arms (200). Bridge member (202) and connecting arms (200) define opening (216) through which optical tape (110) can pass without its vertical movement being restricted. In some versions arms (200) represent resilient grasping members that are used to attach optical tape clips (112) to other structures. Arms (200) include walls (204), which in the present example are generally straight or flat with dimples (205). Dimples (205) can be formed by stamping, molding, or other suitable process, such that dimples (205) project away from first surface (214) of walls (204). Opposite the projecting side of dimples (205), dimples (205) can present as recessed areas in second surface (215) of walls (204). When optical tape clip (112) is installed, dimples (205) provide spacing between first surface (214) of wall (204) and e.g., hoistway header (102). This spacing allows for installation of optical tape clips (112) without binding optical tape (110). So for example, optical tape (110) can be moved vertically to reposition, repair, or replace optical tape (110) without uninstalling optical tape clips (112). Also, dimples (205) assist to prevent optical tape (110), when extending through optical tape clip (112), from substantially deviating in a lateral or horizontal direction as the dimples provide a stopping structure for optical tape (110) to abut against. In some versions dimples (205) have a diameter of about 4 mm, although in other versions greater or lesser diameters for dimples can be used.

Arms (200) also include walls (206), which in the present example include curved portion (207) and first and second angled portions (209, 211) that are resiliently biased such that second angled portions (211) of walls (206) want to return to or maintain a position generally adjacent to walls (204). With the resilient nature of arms (200), optical tape clip (110) is attachable to a mounting feature, e.g., hoistway header (102) and/or mounting bracket (116). In the present example and other versions, optical tape clips (112) can be installed on hoistway headers (102) and/or mounting brackets (116) without the use of tools.

Bridge member (202) of optical tape clip (112) includes extensions (208) that each extend upwardly from inner-most portions of walls (204) of arms (200). Bridge member (202) also includes connecting member (210) that connects and extends between extensions (208).

Figure 7:
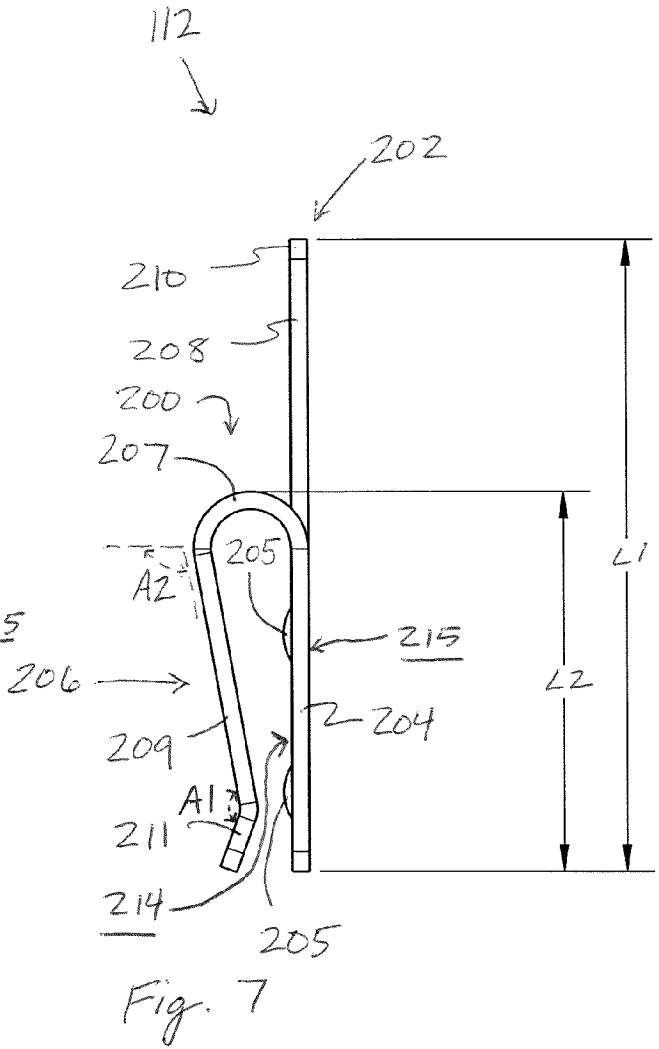
FIG. 7 depicts a side view of the optical tape clip of FIG. 6.

As shown in FIG. 7, a length between a bottom portion of walls (204) and a top portion of extensions (208) is measured as length (L1). Length (L1) may be, for example, about 51 mm, although in other versions length (L1) can be greater or less than about 51 mm. A length between a bottom portion of walls (204) and a top of walls (206) is measured as length (L2). Length (L2) may be, for example, about 31 mm, although in other versions length (L2) can be greater or less than about 31 mm. Walls (206) in the position shown in FIG. 7 have second angled portions (211) that connect with first angled portions (209). In the present example, the angle created by the connection between first and second angled portions (209, 211) (shown in FIG. 7 by A1) is about 150 degrees. In other versions other angles may be used and will be apparent to one of ordinary skill in the art in view of the teachings herein. Second angled portions (211) can have a length of about 5 mm, and the first angled portions (209) can have a length of about 21 mm. The angle defined by one of first angled portions (209) and a horizontal plane intersecting the top part of first angled portions (209) (shown in FIG. 7 by A2) can be about a 100 degree angle, although in other versions this angle can be greater than about 100 degrees or less than about 100 degrees. Curved portions (207) of arm (200) generally and substantially form a U-shape. When installed in an elevator positioning system (100), curved portions (207) are configured to abut against a top portion of a mount, e.g., hoistway header (102), to which optical tape clip (112) mounts, while a lower portion of the mount, e.g., hoistway header (102), is gripped between the inflection point of second angled portions (211) and first angled portions (209) of walls (206) and the surface of walls (204).

Figure 6:
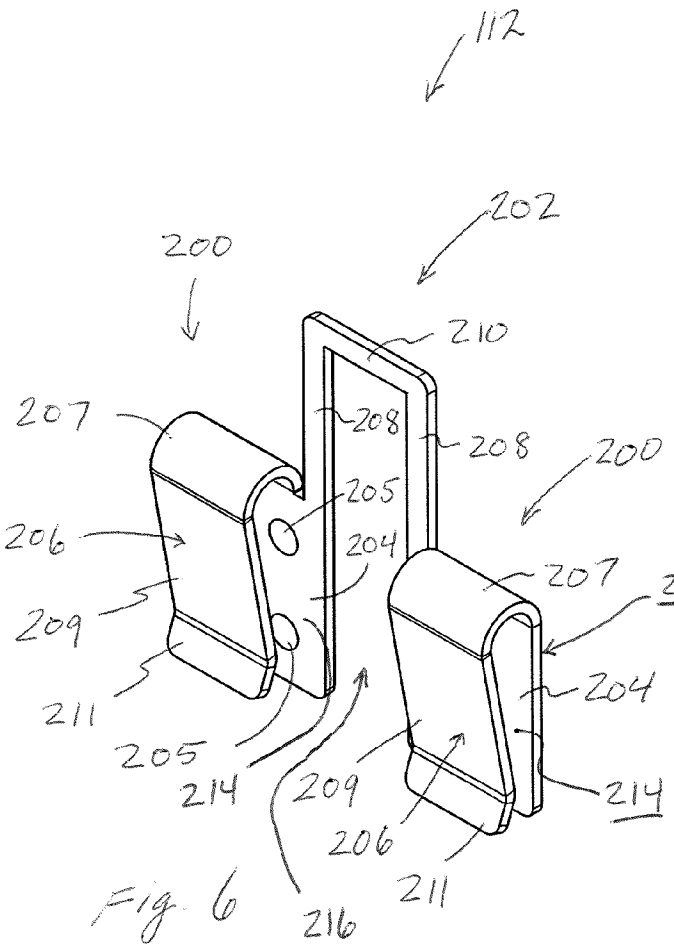
FIG. 6 depicts a perspective view of an exemplary optical tape clip as shown in FIG. 2.
Figures 8, 9:
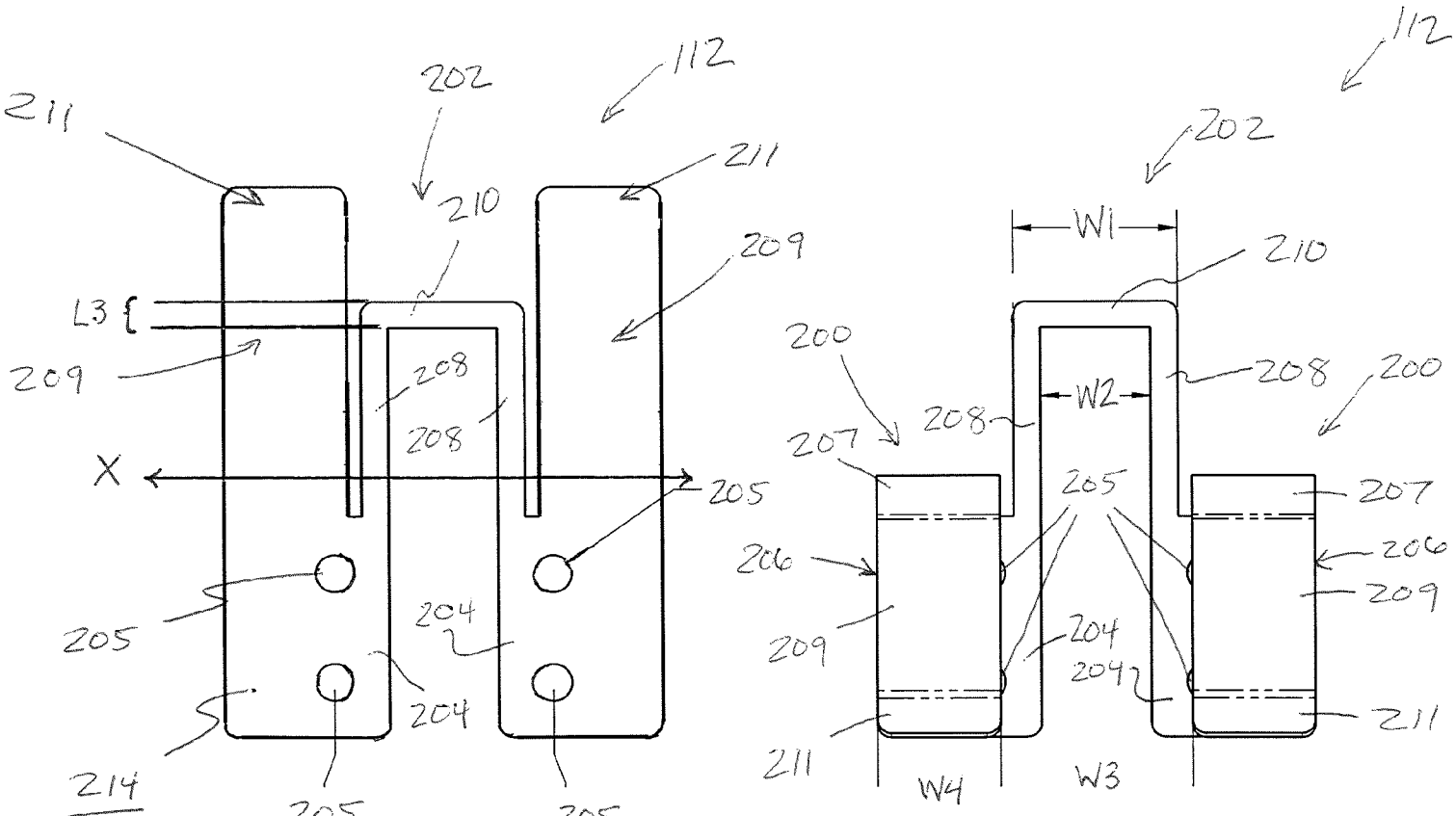
FIG. 8 depicts a front view of the optical tape clip of FIG. 6 in a first, partially shaped form.
FIG. 9 depicts a front view of the optical tape clip of FIG. 6 in a second, fully shaped form.

Referring now to FIGS. 8 and 9, a length between top and bottom portions of connecting member (210) is measured as length (L3). Length (L3) may be, for example, about 3 mm, although in other versions length (L3) can be greater or less than about 3 mm. FIG. 8 also shows optical tap clip (112) in a first position where walls (206) have not yet been formed into curved portions (207) and first and second angled positions (209, 211). To change optical tape clip (112) from this first position as shown in FIG. 8 to its second, fully formed, position as shown in FIGS. 6 and 9 among others, walls (206) that vertically extend from walls (204) can be bent about an axis (shown in FIG. 8 by axis X) such that the portion that becomes second angled portions (211) are moved more closely adjacent to walls (204) and generally adjacent the protruding surface of dimples (205).

Figure 10:
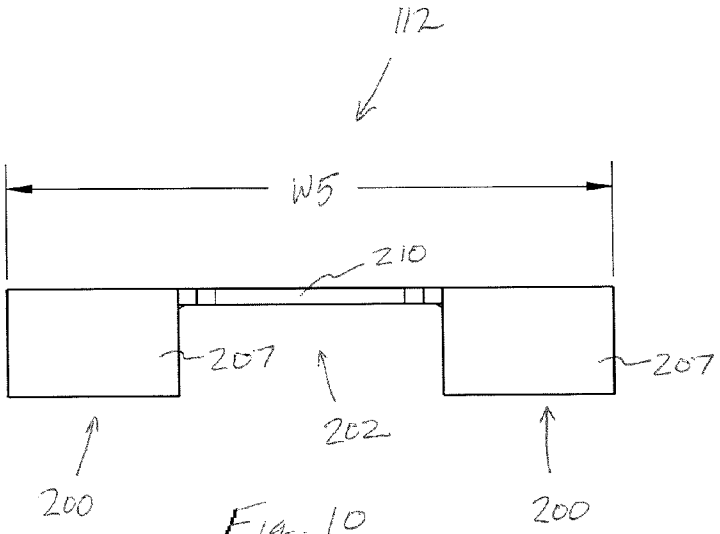
FIG. 10 depicts a top view of the optical tape clip of FIG. 6.

As shown in FIG. 9, a width of connecting member (210) is shown as width (W1) and a width measured between interior portions of extensions (208) is measured as width (W2). Width (W1) may be, for example, about 19 mm, and width (W2) may be about 13 mm, although in other versions widths (W1, W2) can be greater than or less than about 19 mm and 13 mm respectively. A width between walls (206) is measured as width (W3), and a width of walls (206) is measured as width (W4). Width (W3) may be, for example, about 22 mm, and width (W4) may be, for example, about 14 mm, although in other versions widths (W3, W4) can be greater than or less than about 22 mm and 14 mm respectively. As shown in FIG. 10, a width between exterior ends of optical tape clip (112) is measured as width (W5). Width (W5) may be, for example, about 51 mm, although in other versions width (W5) can be greater than or less than about 51 mm.

Figure 11:
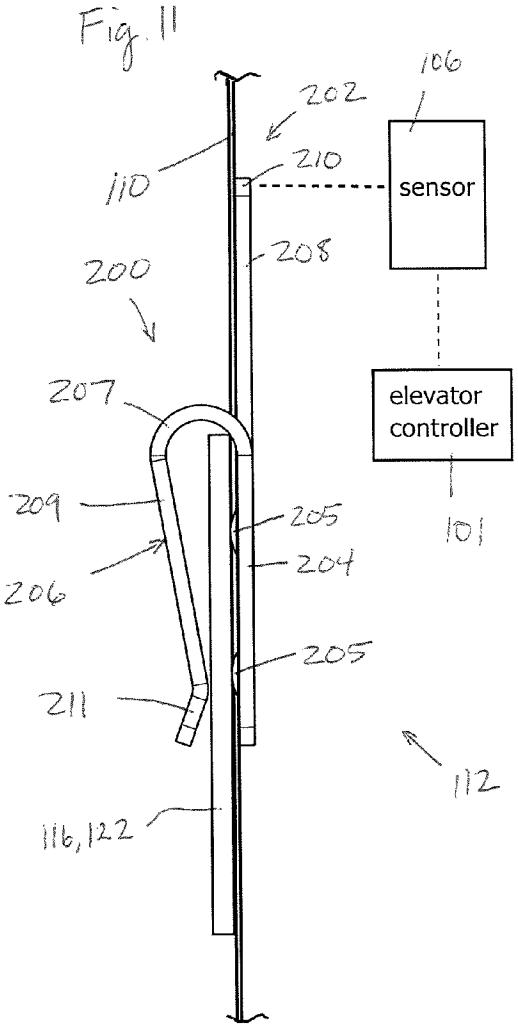
FIG. 11 depicts a side view of the optical tape clip of FIG. 6 shown in an installed configuration.

FIG. 11 shows optical tape clip (112) mounted to a mounting feature such as hoistway header (102) or mounting bracket (116). Prior to the mounting, optical tape (110) is positioned against a surface of hoistway header (102) or mounting bracket (116) as the case may be that faces toward elevator car (30). Optical tape clip (112) is mounted such that bridge member (202) is positioned against or near optical tape (110) and arms (200) securely gripping portions of hoistway header (102) or mounting bracket (116) as the case may be. Also, as seen in FIGS. 3 and 4, the width of optical tape (110) and the position of dimples (205) are such that dimples (205) do not impinge upon or bind optical tape (110) when optical tape clip (112) is mounted to either hoistway header (102) or mounting bracket (116). For instance, in the present example, dimples (205) are located just outside the width of optical tape (110). When optical tape clip (112) is so mounted, first surface (214) of walls (204) face away from elevator car (30) whereas second surface (215) of walls (204) face toward elevator car (30) and toward sensor (106).

Exemplary Operation of Elevator Positioning Systems

When elevator positioning system (100) is assembled as described above, optical tape (110) is mounted in hoistway (10) along the travel path of elevator car (30) and sensor (106) is positioned to sense or detect optical tape (110) as sensor (106) moves with elevator car (30) between landings (50). As shown and described above, optical tape clips (112) are mounted near landings (50) at each floor to hoistway headers (102). When elevator car (30) is moving between landings (50), sensor (106) senses or detects optical tape (110) and observes no interruptions in optical tape (110) until elevator car (30) approaches and/or passes installed optical tape clip (112). The detected interruption in optical tape (110) provides a signal to elevator controller (101) that is also a component of elevator positioning system (100). Moreover, the precise known placement of optical tape clips (112) within hoistway (10) and the known location of landings (50) can be inputs to elevator controller (101) such that the detected interruptions in optical tape (110) allow for elevator controller (101) to control elevator car (30) to stop at a programmed count either below or above the point the interruption in optical tape (110) is detected by sensor (106). The programmed count can be, for example, a distance measurement. This then allows for elevator car (30) to be stopped in alignment with landing (50) such that the floor of elevator car (30) exactly or substantially aligns with the floor of landing (50).

In some versions although not required in all versions, through positioning multiple optical tape clips (112) at spaced intervals, multiple indications of interruptions detected by sensor (106) can provide elevator controller (101) with verification that the sensed interruption was caused by the presence of optical tape clips (112) and not that an anomaly interruption in optical tape (110) was detected.

In some versions, although not required in all versions, one optical tape clip (112) may be positioned within hoistway such that it is directly across from sensor (106) when elevator car (30) is positioned at one of landings (50). For example, in such versions, with elevator car (30) aligned with landing (50), sensor would be "seeing" or detecting an interruption in optical tape (110) as connecting member (210) would be directly in front of the field of view of sensor (106). Still yet there may be other optical tape clips (112) mounted above and below the optical tape clip (112) that is positioned within hoistway such that it is directly across from sensor (106) when elevator car (30) is positioned at one of landings (50). In such versions, elevator controller (101) may be programmed, by way of example only and not limitation, to slow elevator car (30) down when a first optical tape clip (112) is passed (and a first interruption in optical tape (110) is detected) in preparation for approaching a landing (50). Then when the second optical tape clip (112) is detected elevator controller (101) may stop elevator car (30) as elevator controller (101) as programmed now confirms that elevator car (30) is aligned with landing (50). In view of the teachings herein, other ways to position optical tape clips (112) and program elevator controller (101) to control elevator car (30) and align elevator car (30) with a landing (50) will be apparent to those of ordinary skill in the art.

Also, elevator positioning system (100) is capable of calculating, accounting for, and/or compensating for building compression phenomenon that can occur in multi-story buildings. In such instances where building compression has occurred after the installation of elevator positioning system (100), even with such compression, elevator positioning system (100) is still able to align elevator car (30) with landings (50) as described further below. By way of example and not limitation, after building (20) has been constructed, building (20) may undergo a compression due to settling and other factors apparent to those of ordinary skill in the art in view of the teachings herein. In the above example, hoistway headers (102) are associated with landings (50), and hoistway headers (102) are connected between entrance struts (104) in hoistway (10). Struts (104) are connected to the front wall of hoistway (10) and thus undergo a similar amount of compression as building (20) and its landings (50) experience. Likewise, hoistway headers (102) are impacted by the compression similarly as hoistway headers (102) are connected with struts (104). As time progresses and building compression occurs, the position of landings (50) relative to hoistway headers (102) installed between struts (104) is largely unchanged. At the same time the relative distance between one hoistway header (102) and the next hoistway header (102) (or one landing (50) and the next landing (50)) may have changed due to building compression. However, because, in the present example, positioning elevator car (30) can be based on measuring the relative movement from one landing (50) to another landing (50) after compression by detecting interruptions associated with optical tape clips (112) installed at hoistway headers (102), along with the fact that optical tape (110) can freely move vertically and thus its configuration for proper functioning is not disturbed by building compression, the system can continue to properly position and align elevator car (30) with landings (50) even though building compression may have occurred. With respect to measuring and compensating for building compression, sensor (106) can be used to detect relative changes in the distances between the various mounted optical tape clips (112) in the system, e.g., measuring the distance between an optical tape clip (112) on one hoistway header (102) compared to another optical tape clip (112) on another hoistway header (102). This data can be captured at some desired frequency and processed to evaluate building compression over time and how various regions of building (20) may be affected differently by building compression. In other words, differences in measurements over time between optical tape clips (112) on hoistway headers (102) provides information indicating the location and amount of compression a building has experienced. Furthermore, elevator controller (101) can be updated as needed based on the compression data gathered over time to keep elevator positioning system (100) operating properly to align elevator car (30) with landings (50). Such updates to elevator controller (101) can include updating or adjusting a programmed count either below or above a detected optical tape clip (112) at a hoistway header (102) for stopping elevator car (30).

Exemplary Alternative Mounting Arrangement

FIGS. 12-15 illustrate an exemplary alternative mounting arrangement for elevator positioning system (300), similar to elevator positioning system (100) described above, using optical tape (110), optical tape clips (112), and sensor (106) but mounted in this version in an orientation that is generally perpendicular to the orientation described above with reference to FIGS. 1-11. In the illustrated versions here as before, elevator positioning system (300) is used with elevator car (30) disposed in hoistway (10). Optical tape clips (112) are mounted to mounting brackets (316) attached to rails (40) but in a fashion where mounting brackets (316) and optical tape clips (112) extend generally perpendicular to the openings for accessing landings (50).

Sensor (106) is attached to crosshead (308) via crosshead bracket assembly (324) that comprises first portion (325), second portion (326), and third portion (327). Crosshead (308) extends between rails (40) and crosshead bracket (324) extends generally perpendicular to rails (40). Optical tape clips (112) are configured to receive and help stabilize optical tape (110) substantially in a desired position running along a length of hoistway (10), as described above with respect to elevator positioning system (100). In this mounting arrangement, a surface of optical tape (110) substantially faces the direction of sensor (106), which is configured to sense optical tape (110) and any interruptions such as those caused by optical tape clips (112), in a manner similar to that described above for elevator positioning system (100).

Figure 14:
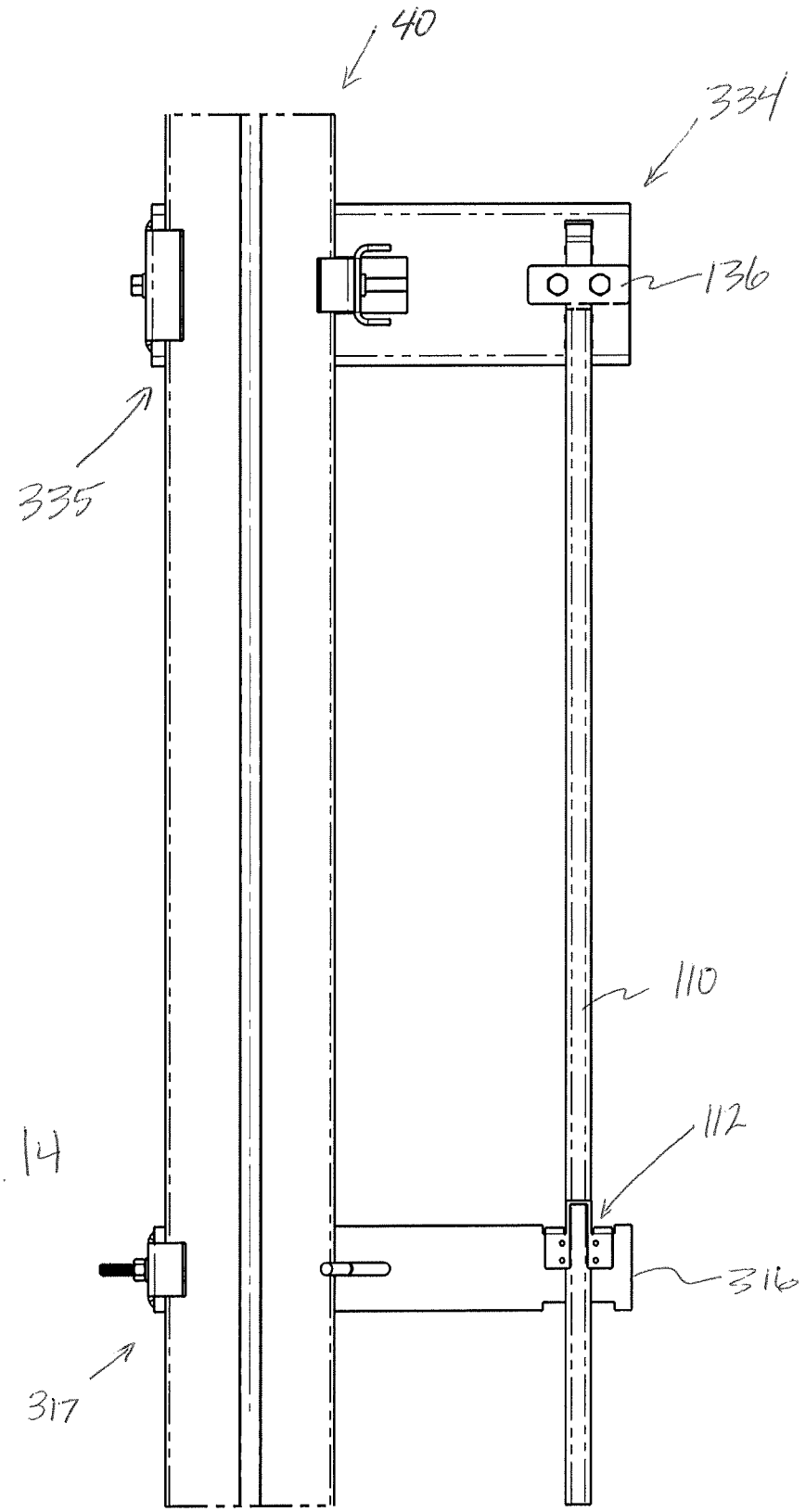
FIG. 14 depicts a side view of a top portion of the hoistway of FIG. 12.

Rails (40) comprise first rail portions (45) to which mounting brackets (316) are configured to attach. In the present example, mounting brackets (316) attached to rails (40) at first rail portions (45) using a clamp mechanism (317) as shown in FIG. 14. Still other ways to attach mounting brackets (316) to rails (40) will be apparent to those of ordinary skill in the art in view of the teachings herein. Optical tape clips (112) are configured to attach to mounting brackets (316) in the same or similar fashion as described above with respect to hoistway headers (102) and mounting brackets (116). Similarly, optical tape (110) is positionable within optical tape clips (112) when attached to mounting bracket (316) in the same or similar fashion as described above with respect to optical tape clips (112) and their attachment to hoistway headers (102) mounting brackets (116, 122).

Figure 13:
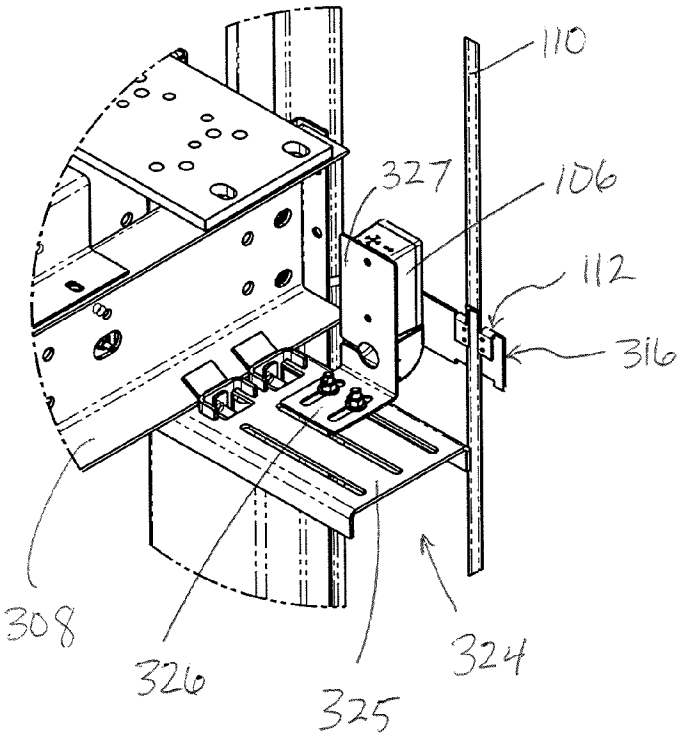
FIG. 13 depicts a detail view of a portion of the hoistway shown in FIG. 12.
Figure 12:
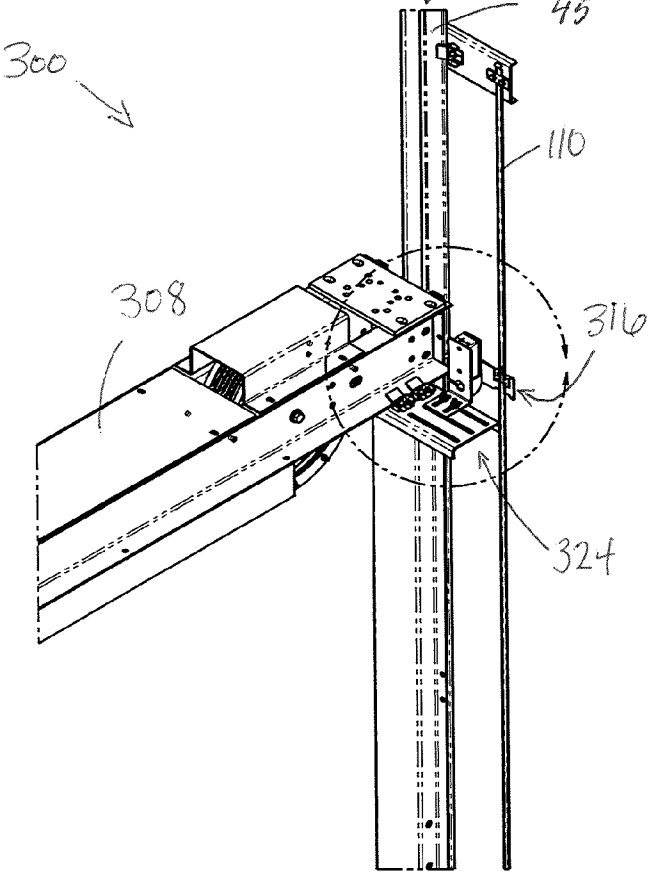
FIG. 12 depicts a partial perspective view of an exemplary hoistway showing another optical tape clip mounting configuration.

When installed in this illustrated mounting arrangement, a surface of optical tape (110) faces toward a side of elevator car (30). Elevator car (30) includes elevator crosshead (308) to which sensor (106) is attached as mentioned above. First portion (325) of crosshead bracket assembly (324) is configured to attach to crosshead (308) transversely projecting from crosshead (308) via fasteners such as screws, bolts, clamps, and the like. Second portion (326) of crosshead bracket assembly (324) connects with first portion (325) via one or more bolts that extend through apertures. Third portion (327) of crosshead bracket assembly (324) connects with second portion (326) and upwardly projects from first and second portions (325, 326). A rear portion of sensor (106) is configured to attach to third portion (327) or crosshead bracket assembly (324) such that a front, detecting portion of sensor (106) faces toward positioned optical tape (110), as shown in FIGS. 12 and 13.

Figure 15:
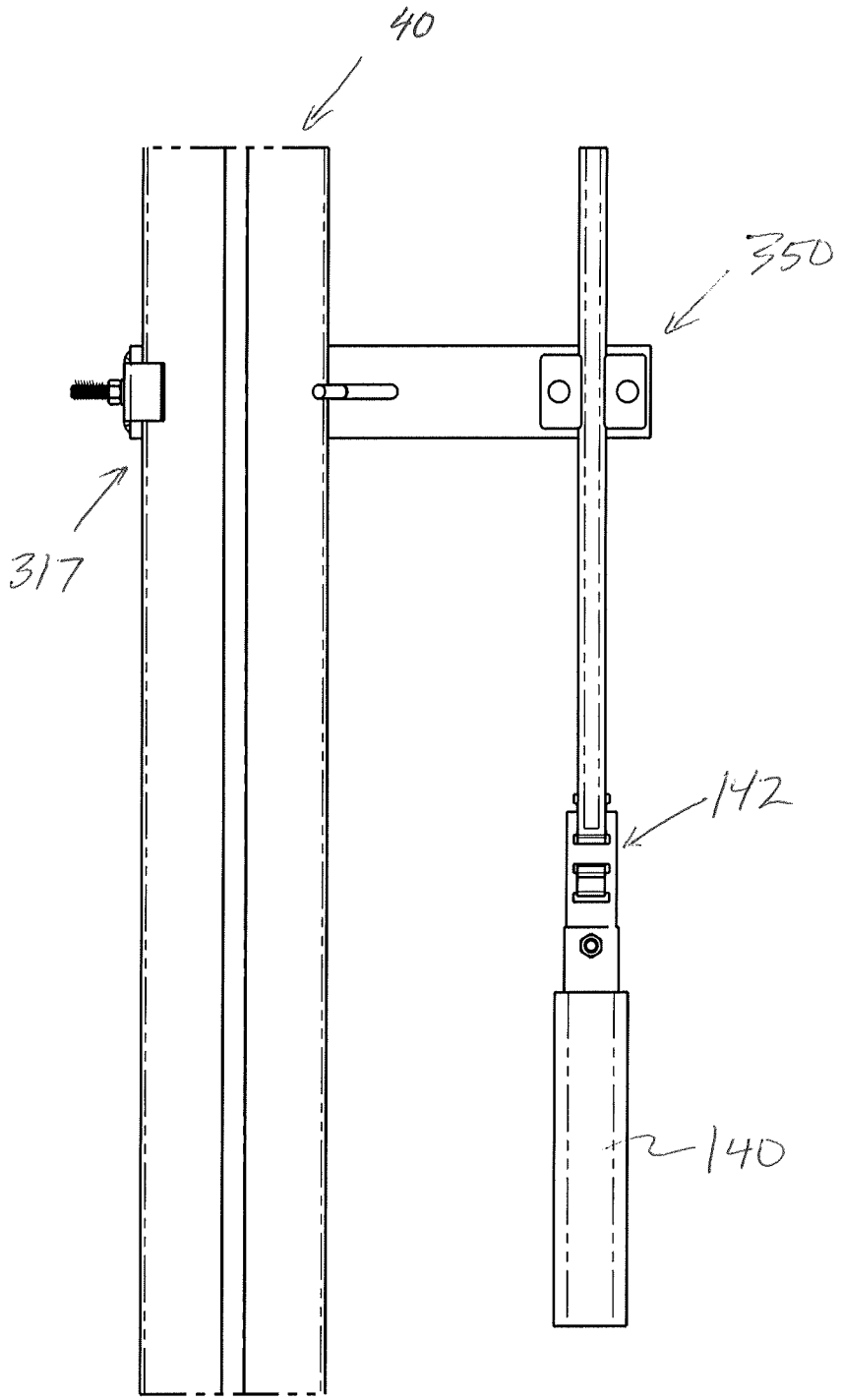
FIG. 15 depicts a side view of a bottom portion of the hoistway of FIG. 12.

FIGS. 14 and 15 illustrate how optical tape (110) is mounted at top and bottom portions of rails (40). FIG. 14 shows a top portion including top mounting bracket (334) that includes fastener (335) in the form of a clamp sized and shaped to be securely positioned about rail (40). Top mounting bracket (334) may receive optical tape (110) and be constructed in a manner similar to top mounting bracket (134) described above and may also include clamp (136) as described above.

FIG. 15 shows a bottom portion of rails (40) showing weight component (140) and bottom mounting plate (142), which are described above with respect to elevator positioning system (100). Bracket (350) is configured to receive optical tape (110) and is configured to be disposed substantially near and above bottom mounting plate (142). Bracket (350) is fastened to rail (40) using clamp (317) the same or similar to the way mounting bracket (316) connects with rails (40).

Elevator positioning system (300) operates in a manner similar to elevator positioning system (100) described above. In the present example of elevator positioning system (300), optical tape clips (112) are mounted to rails (40) via mounting brackets (316). Mounting brackets (316) are positioned such that optical tape clips (112) are located at every floor landing such that the vertical distance between mounting brackets (316) is equal to the floor-to-floor height. Sensor (106) moves with crosshead (308) which moves with elevator car (30) through hoistway (10). As sensor (106) travels it detects optical tape (110) and any interruptions when passing by connecting member (210) of optical tape clips (112). This then signals elevator controller (101) as described further previously.

Optical tape clips (112) can be constructed of metal or plastic or other materials that will permit the connections and functions of optical tape clips (112) described herein. In some versions optical tape clips (112) are constructed of stainless steel. In view of the teachings herein, other materials of construction for the components described will be apparent to those of ordinary skill in the art. In versions described above, optical tape clip (112) comprises a single piece or has a unitary construction. Of course in other versions optical tape clips (112) may be made of more than one piece joined together.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

I claim:

1. An elevator positioning system for use in aligning an elevator car with one or more landings, wherein the elevator car is operable to travel within a hoistway along a set of rails to the one or more landings, wherein the elevator positioning system comprises:

a. an optical sensor configured to attach to a portion of the elevator car;

b. an optical tape, wherein the optical tape is detectable by the sensor, wherein the optical tape extends along the travel path of the elevator car; and c. an optical tape clip comprising:

i. one or more resiliently biased arms configured to grasp a portion of the hoistway to which the optical tape clip is configured to be attached, ii. one or more projecting members configured to stabilize a lateral position of the optical tape, iii. an opening through which the optical tape may extend without restricting vertical movement of the optical tape, and iv. a portion configured to be disposed to block the view of the optical tape to interrupt detection of the optical tape.

2. The system of claim 1, wherein the optical tape, the sensor, and the optical tape clip are mounted within the hoistway in a direction facing the one or more landings.

3. The system of claim 1, wherein the optical tape, the sensor, and the optical tape clip are mounted within the hoistway in a direction perpendicular to the one or more landings.

4. The system of claim 1, further comprising an elevator controller, wherein the sensor is configured to transmit signals to the elevator controller in response to detecting an interruption in the optical tape, wherein the elevator controller controls the elevator stopping position based upon the signals from the sensor.

5. The system of claim 1, comprising a plurality of optical tape clips, wherein the distance between at least two of the plurality of optical tape clips is determined based upon the sensor detecting interruptions in the optical tape.

6. An optical tape clip for use in an elevator hoistway in which an elevator car travels along a set of rails to one or more landings, wherein the optical tape clip is configured to receive an optical tape and configured to attach to a portion of the hoistway, wherein the optical tape clip comprises:

a. one or more resiliently biased arms configured to grasp the portion of the hoistway to which the optical tape clip is configured to be attached;

b. one or more projecting members configured to stabilize a lateral position of the optical tape;

c. an opening through which the optical tape may extend without restricting vertical movement of the optical tape; and d. a portion configured to be disposed to block the view of the optical tape to interrupt detection of the optical tape.

7. The optical tape clip of claim 6, wherein the optical tape clip is attachable to a select one of a hoistway header and a rail of the set of rails.

8. The optical tape clip of claim 6, wherein the optical tape clip is attachable via a bracket configured to be fastened to a select one of an entrance strut and a rail of the set of rails.

9. The optical tape clip of claim 6, wherein the optical tape clip is attachable to the portion of the hoistway without the use of tools.

10. The optical tape clip of claim 6, wherein the optical tape clip is a unitary component.

11. The optical tape clip of claim 10, wherein the optical tape clip is attachable to the portion of the hoistway without the use of tools.

12. The optical tape clip of claim 6, wherein the optical tape clip is comprised of a single piece of a select one of stainless steel and plastic.

13. A method for positioning and aligning an elevator car with a landing using a sensor, an optical tape, and at least one optical tape clip, wherein the method comprises:

a. attaching the sensor to the elevator car;

b. attaching the at least one optical tape clip to a select one of a portion of a hoistway or an elevator guide rail, wherein the at least one optical tape clip comprises:

i. one or more resiliently biased arms configured to grasp the select one of the portion of the hoistway or the elevator guide rail, ii. one or more projecting members configured to stabilize a lateral position of the optical tape, iii. an opening through which the optical tape may extend without restricting vertical movement of the optical tape, and iv. a portion configured to be disposed to block the view of the optical tape to interrupt detection of the optical tape by the sensor;

c. extending the optical tape through the at least one optical tape clip, wherein the at least one optical tape is positioned to face the sensor; and d. moving the elevator car such that the sensor detects the optical tape and interruptions caused by the portion of the at least one optical tape clip being positioned between the optical tape and the sensor.

14. The method of claim 13, further comprising transmitting information from the sensor to an elevator controller to control the speed of the elevator car.

15. The method of claim 14, further comprising detecting a series of interruption signals and transmitting the series of interruption signals from the sensor to the elevator controller, wherein the elevator controller controls the elevator car to stop the elevator car at the landing in response to the series of interruption signals.

* * * * *